US006436270B1

(12) United States Patent
Sander

(10) Patent No.: US 6,436,270 B1
(45) Date of Patent: Aug. 20, 2002

(54) METHOD AND DEVICE FOR CONTROLLING THE MOVEMENT OF A FEEDING AND BREAKING CHISEL IN AN ALUMINUM PRODUCTION CELL

(75) Inventor: Lars-Göran Sander, Huddinge (SE)

(73) Assignee: AB Rexroth Mecman, Stockholm (SE)

( * ) Notice: Subject to any disclaimer, the term of this patent is extended or adjusted under 35 U.S.C. 154(b) by 0 days.

(21) Appl. No.: 09/357,521

(22) Filed: Jul. 19, 1999

(51) Int. Cl.[7] ..... C25C 1/00

(52) U.S. Cl. ..... 205/336; 205/337; 204/228.1; 204/228.5; 204/229.4; 204/229.8; 204/230.5; 204/243.1; 204/247.5

(58) Field of Search ..... 91/27, 28, 32, 91/33; 204/243.1, 245, 275.1, 229.4, 229.8, 229.7, 228.1, 228.5, 205, 211, 230.5, 230.8, 247.5; 205/335, 336, 337

(56) References Cited

U.S. PATENT DOCUMENTS

| | | | | |
|---|---|---|---|---|
| 4,377,452 A | | 3/1983 | Casdas | 204/67 |
| 4,563,255 A | | 1/1986 | Heinzmann et al. | 204/67 |
| 4,606,257 A | | 8/1986 | Pfister | 91/27 |
| 4,700,612 A | * | 10/1987 | Pfister | 91/27 |
| 5,163,353 A | | 11/1992 | Horstmann et al. | 91/426 |

FOREIGN PATENT DOCUMENTS

| | | |
|---|---|---|
| EP | 215 764 | 3/1987 |
| WO | WO 96/02764 | 2/1996 |

* cited by examiner

*Primary Examiner*—Bruce F. Bell
(74) *Attorney, Agent, or Firm*—Townsend and Townsend and Crew LLP

(57) ABSTRACT

A method and a device for controlling the movement of a combined alumina feeding and crust breaking chisel in an aluminum production cell, wherein the chisel is moved downwards and upwards by means of a pneumatic cylinder which is alternatively fed with pressurized air, wherein electrical contact between the chisel and the melt is detected when the chisel reaches the melt, wherein it is monitored whether said electrical contact has been reached within a predetermined time interval, and if not, air at a second, high, pressure is fed to said first, and wherein air at high pressure is fed to the second side of the cylinder after said electrical contact has been established so as to quickly withdraw the chisel from the hot melt in order to minimize heat transfer from the melt to the cylinder.

7 Claims, 1 Drawing Sheet

METHOD AND DEVICE FOR CONTROLLING THE MOVEMENT OF A FEEDING AND BREAKING CHISEL IN AN ALUMINUM PRODUCTION CELL

This invention concerns a method and a device for controlling the movement of a pneumatic cylinder operated combined alumina feed and crust breaking chisel in an aluminum production cell.

BACKGROUND OF THE INVENTION

Whether for pre-baked, Söderberg or other ovens, a chisel is moved downwards through a crust, which covers a melt of molten aluminium, in order to feed the cell with alumina, and upwards to a rest position. The chisel, which is also referred to as a point feeder, in its reciprocating movement brings along the powder-shaped alumina through the crust into the melt.

During this movement it is important that the chisel effectively breaks through the crust so as to safely penetrate into the melt in order to fulfil the feeding function. This is sometimes a problem since the resistant afforded by the crust varies over time to sometimes be very great. Also the level of the surface of the melt and thus the crust varies over time.

U.S. Pat. No. 4,347,452 concerns an apparatus using the Hall-Heroult process, wherein the movement of a reciprocating plunger, which is electrically insulated, is monitored so as to establish if it has penetrated into the melt or not. If negative, the electrical power supply to the cell is increased in order to re-melt solidified electrolyte. It is also discussed to adjust the travel of the plunger in dependence on the level of the surface of the melt.

U.S. Pat. No. 4,563,255 discloses that energy applied to the crust breaking device is increased by raising the lowering force if necessary to penetrate the crust.

U.S. Pat. No. 4,606,257 addresses the problem of compressed air consumption in connection with the movement of the feeding and crust breaking chisels, which are moved by pneumatic cylinders. In order to reduce the consumption, initially in the downward movement it is arranged to feed with reduced pressure. If the chisel fails to reach the desired position, the pressure acting on the working cylinder, and thus the force on the chisel, is increased. This document also discloses re-use of air from the side of the cylinder, which is inactive.

Reference may also be made to U.S. Pat. No. 5,163,353.

The first two mentioned prior art solutions suffer from potential high compressed air consumption and poor point feeder control, whereas the solutions according to the two latter documents potentially suffer from reduced working life of the associated working cylinder, increased maintenance and replacement costs.

SUMMARY OF THE INVENTION

It is an aim of this invention to provide a method and a device according to the above, wherein compressed air consumption is optimised while providing possibility of prolonged working life of the working cylinder and thus reduced costs.

This aim is obtained according to the invention by, during the downward movement, feeding the first side of the cylinder with air at a first, low, pressure no longer than a predetermined time period, monitoring whether said electrical contact has been detected within said time period, and if not, feeding air at a second, high, pressure to said first side until electrical contact has been detected, and feeding air at high pressure to the second side of the cylinder after said electrical contact has been detected so as to quickly withdraw the chisel from the melt in order to minimize heat transfer from the melt to the cylinder.

Hereby harmful heating of the cylinder is reduced to a minimum, resulting in lower costs for maintenance and replacements, and in total, fewer production stops. In many instances it has been noticed that the chisel movement away from the crust is obstructed because it has been stuck to the crust. This would result in prolonged dwell time in an environment where harmful heating results. According to the invention, the chisel is almost instantaneously pulled away from this environment, this way resulting in the desired reduced heating.

By setting the predetermine time period so as to minimise the time of contact between the chisel and the crust, the heat transfer also during the downward movement is reduced.

According to a preferred embodiment of the invention, the cylinder is fed with air with a high pressure at the initial part of the upward movement and fed with air at a low pressure in the remaining path upwards. This arrangements ensures minimal heat transfer, since the chisel is quickly pulled out from the melt and the crust, while ensuring low compressed air consumption. This effect is enhanced when the initial part is the part where any substantial heat transfer to the chisel occurs.

By having the chisel moved further into the melt after the electrical contact has been detected, effective alumina feed is guaranteed.

BRIEF DESCRIPTION OF THE DRAWINGS

The invention will now be described in more detail at the background of an embodiment and with reference to the drawings, wherein.

DETAILED DESCRIPTION OF THE PREFERRED EMBODIMENTS

Figure 1:
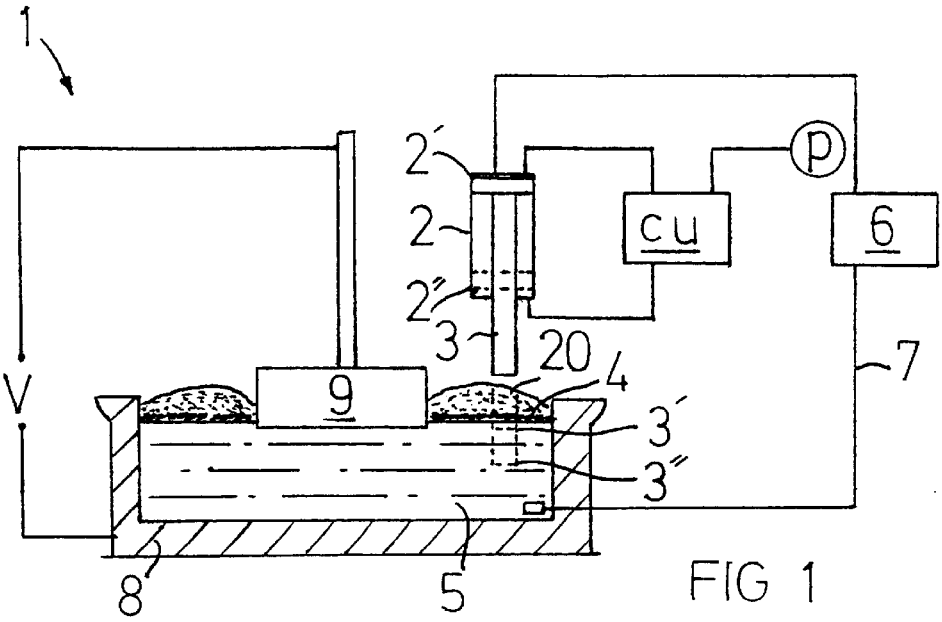
FIG. 1 diagrammatically shows the application of the invention in an aluminum production oven.

In FIG. 1 numeral 1 depicts a device for controlling the movement of a combined feeder and crust breaking device, including a chisel 3. The chisel is directly connected to a pneumatic working cylinder 2, having a first side cylinder space 2' and a second side cylinder space 2" . The cylinder 2 is as usual fed with pressurised air to the respective sides for an alternating downward and upward movement. A pressurised air supply is depicted with P and a control unit is depicted with CU. A cathodic vessel 8 contains molten metallic aluminum 5, at the top of which a hard crust 4 is formed during the process. During operation a high current and a low DC-voltage V prevails between the cathodic vessel 8 and an anode 9.

Powder-formed alumina 20 is fed to the position of the chisel 3 in a per se known manner, which is not shown here. During its downward movement, the chisel 3 brings along part of this powder form alumina into the melt for processing in the oven.

The invention will now be described with reference also to FIG. 2.

In order to reduce the consumption of compressed air, the downward movement (10 in FIG. 2) of the chisel 3 is initiated with a low pressure in the cylinder 2, resulting in a moderate downward force (and speed) of the chisel 3. When the chisel 3 reaches the region of the hard crust, it will experience a resistance from the crust against further movement, which resistance may vary depending on the amount of crust formed at the moment and the nature of the crust. This resistance slows down the chisel, which is indicated with sequence 11 on FIG. 2, whereby the chisel even might be completely stopped before it has reached the melt, when it is driven by the prevailing low pressure.

If, however, electrical contact between the chisel 3 and the melt has not been detected by an electric AC circuit 6, 7 within a predetermine time period $t_1$, the CU switches the air supply to the cylinder 2 so that high pressure is fed to the first side 2' of the cylinder. The sequence after $t_1$ is indicated with 12 in FIG. 2, whereby the chisel 3 with substantial force will break through the crust 4 so as to dip down into the melt 5 to d, whereby the AC circuit 6, 7, 2, 3, 5 is closed.

In this connection it should be mentioned that the crust and the alumina powder act as electric insulators, wherefore no electric contact is established before the chisel 3 has reached the melt.

After electric contact has been detected at 3', the control unit CU switches the compressed air feed to the cylinder 2 such that high pressure compressed air is directly fed to the second side 2" of the cylinder 2. This sequence is indicated with 13 in FIG. 2 and results in a very fast pull-out of the chisel 3 froth the melt and from the region where there is any substantial heat transfer to the chisel 3. This sequence lasts between $t_2$, where the upward movement starts and $t_3$. This interval may be set short, so as to guarantee an over-all low compressed air consumption.

The fast pull-out with high pressure ensures that the chisel is not stuck in the low position, which could otherwise occur if low pressure would prevail inside space 2" at the beginning of the upward movement and if the crust acts so as to apply a holding force on the chisel.

Figure 2:
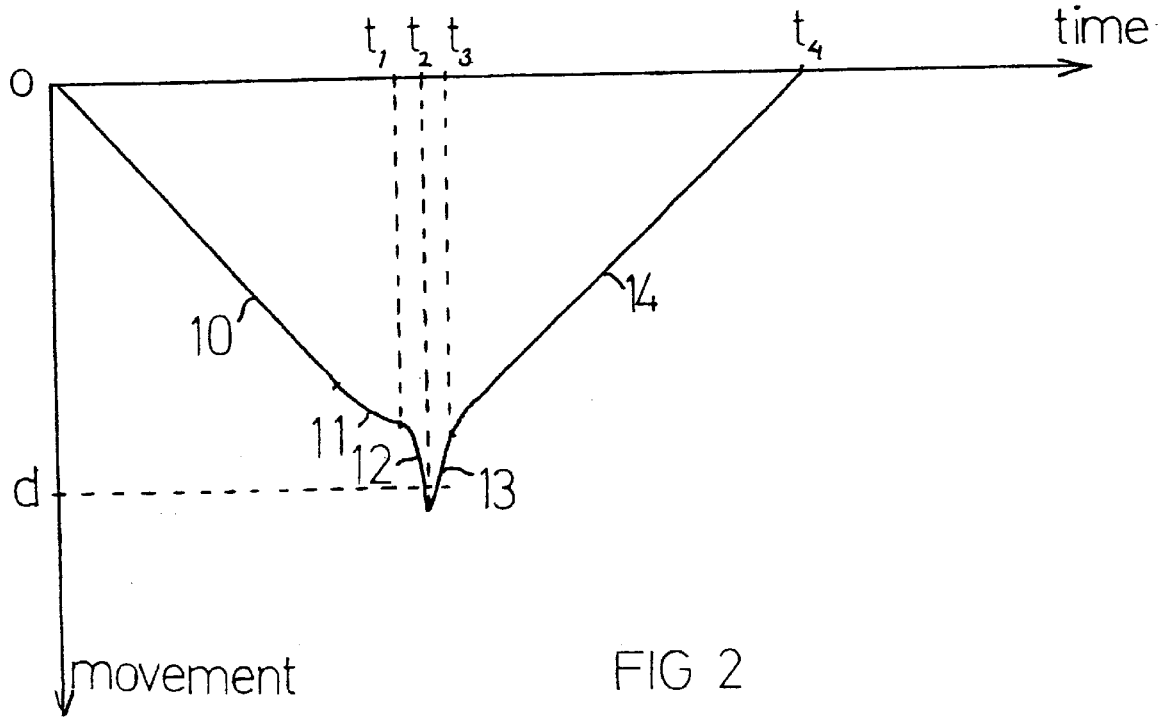
FIG. 2 shows a diagram over the movement of the chisel in FIG. 1 as a function of time.

After the pull-out, the second side 2" of the cylinder is fed with low pressure pressurised air so as to save compressed air, indicated with 14 in FIG. 2, until the chisel is brought back to its rest position at $t_4$.

The invention may be modified within the scope of the claims. At times the resistance from the crust is low and electric contact will be detected within the predetermined time period $t_1$. In these cases the sequence 13 will follow immediately after a modified sequence 10, 11 as seen in FIG. 2, which in that case would be substantially a straight line. For some applications the sequence 11 may continue until the chisel has reached its rest position, this is, however, not preferred with respect to compressed air consumption.

In some occasions it is advantageous to let the chisel 3 continue its downward movement 3" into the melt for a certain adjustable period of time after electric contact has been detected. This is because of enhanced feeding purposes, whereby a chosen dip into the melt is made possible, and in these instances it is even more advantageous to provide a fast final downward movement as well as a fast pull-out of the point feeder into and from the heat transfer region respectively, so as to minimise heating of the chisel as much as possible.

It is envisaged that the respective return side of the cylinder 2 is emptied in any suitable way. For example it is preferred that said side is emptied substantially to the atmosphere when high force is needed.

High pressure with respect to this invention means a pressure of about 5–10 bar and low pressure may be about 30–70% of the high pressure depending of the prevailing circumstances.

According to the invention it is envisaged that the working cylinder as much as possible is protected from heat transfer from the melt over the chisel. This results in prolonged working life for the cylinder as a whole and in particularly for the sealing rings and the bearings of the cylinder. This brings about lower maintenance and investment costs while maintaining comparatively low compressed air consumption.

What is claimed is:

1. In a method for controlling the movement of a combined alumina feeding and crust breaking chisel in an aluminum production cell, the chisel is moved downwards, through a crust which covers a melt of molten aluminum, and upwards, by means of a pneumatic cylinder which is alternatively fed with pressurized air to a first side for downward movement and to a second side for upward movement, wherein electrical contact between the chisel and the melt is detected when the chisel reaches the melt, wherein, during the downward movement, the first side of the cylinder is fed with air at a first, low, pressure no longer than a predetermined time period, wherein it is monitored whether said electrical contact has been detected within said time period, and if not, air at a second, high, pressure is fed to said first side until electrical contact has been detected, wherein air at high pressure is fed to the second side of the cylinder after said electrical contact has been detected at the initial part of the upward movement so as to quickly withdraw the chisel from the melt in order to minimize heat transfer from the melt to the cylinder, and wherein the second side of the cylinder is fed with air at low pressure in the remainder part of the upward movement in order to save pressurized air.

2. A method according to claim 1, wherein the predetermined time period is set so as to minimize the time of contact between the chisel and the crust.

3. A method according to claim 1, wherein the electrical contact between the melt and the chisel is monitored by an AC-circuit.

4. A method according to claim 1, wherein said initial part is essentially the part where any substantial heat transfer to the chisel occurs.

5. A method according to claim 1, wherein after the electrical contact has been detected, the chisel is moved further into the melt at given intervals.

6. Device for controlling the movement of a pneumatic cylinder operated combined alumina feeding and crust breaking chisel in an aluminum production cell, wherein the chisel is moved downwards, through a crust which covers a melt of molten aluminum, and upwards, and including:

means for alternatively feeding the cylinder with pressurized air to a first side for downward movement and to a second side for upward movement, means for detecting electrical contact between the chisel and the melt when the chisel reaches the melt, means for feeding, during the downward movement, the first side of the cylinder with air at a first, low, pressure no longer than a predetermined time period, means for monitoring whether said electrical contact has been detected within said time period, means, operative if no electrical contact is detected within said time period, for feeding air at a second, high, pressure to said first side until electrical contact has been detected, means for feeding air at high pressure to the second side of the cylinder at the initial part of the upward movement after said electrical contact has been detected so as to quickly withdraw the chisel from the hot melt in order to minimize heat transfer from the melt to the cylinder, and means for feeding the second side of the cylinder with air at a low pressure in the remainder part of the upward movement in order to save pressurized air.

7. Apparatus for production of aluminum including a cathodic vessel for containing a melt of molten aluminum, anode means and an electric source for generating an electric current between the cathodic vessel and the anode means, a device for controlling the movement of a pneumatic cylinder operated combined alumina feeding and crust breaking chisel, wherein the chisel is moved downwards, through a crust, which covers the melt, and upwards, and including:

means for alternatively feeding the cylinder with pressurized air to a first side for downward movement and to a second side for upward movement, means for detecting electrical contact between the chisel and the melt when the chisel reaches the melt, means for feeding, during the downward movement, the first side of the cylinder with air at a first, low, pressure no longer than a predetermined time period, means for monitoring whether said electrical contact has been detected within said time period, means, operative if no electrical contact is detected within said time period, for feeding air at a second, high, pressure to said first side until electrical contact has been detected, means for feeding air at high pressure to the second side of the cylinder at the initial part of the upward movement after said electrical contact has been detected so as to quickly withdraw the chisel from the hot melt in order to minimize heat transfer from the melt to the cylinder, and means for feeding the second side of the cylinder with air at a low pressure in the remainder part of the upward movement in order to save pressurized air.

* * * * *